US006688571B1

(12) United States Patent
Pauls

(10) Patent No.: US 6,688,571 B1
(45) Date of Patent: Feb. 10, 2004

(54) ADJUSTABLE JOYSTICK SUPPORT AND WHEELCHAIR THEREWITH

(75) Inventor: Darryl R. Pauls, Visalia, CA (US)

(73) Assignee: Sunrise Medical HHC Inc., Longmont, CO (US)

( * ) Notice: Subject to any disclaimer, the term of this patent is extended or adjusted under 35 U.S.C. 154(b) by 307 days.

(21) Appl. No.: 09/976,875

(22) Filed: Oct. 12, 2001

(51) Int. Cl.[7] ..... E04G 3/00

(52) U.S. Cl. ..... 248/282.1; 280/304.1; 297/DIG. 4

(58) Field of Search ..... 248/282.1, 285.1, 248/274.1, 276.11, 289.11, 205.3; 280/304.1; 297/DIG. 4

(56) References Cited

U.S. PATENT DOCUMENTS

| | | | | |
|---|---|---|---|---|
| 2,085,227 A | | 6/1937 | Norman | |
| 3,253,340 A | | 5/1966 | Farnam | |
| 3,637,184 A | | 1/1972 | O'Brien | |
| 4,183,578 A | | 1/1980 | Naganawa | |
| 4,234,150 A | | 11/1980 | Mee et al. | |
| 4,417,764 A | | 11/1983 | Marcus et al. | |
| 4,546,506 A | | 10/1985 | Houle et al. | |
| 5,246,240 A | * | 9/1993 | Romich et al. | 280/304.1 |
| 5,248,183 A | | 9/1993 | Gignac et al. | |
| 5,326,063 A | | 7/1994 | Stevens | |
| 5,374,104 A | | 12/1994 | Moore et al. | |
| 5,813,727 A | | 9/1998 | Sugawa et al. | |
| 5,853,220 A | | 12/1998 | Gulich et al. | |
| 6,170,598 B1 | | 1/2001 | Furukawa | |
| 6,179,263 B1 | | 1/2001 | Rosen et al. | |
| 6,511,131 B1 | | 1/2003 | Harnois | 297/411.23 |

FOREIGN PATENT DOCUMENTS

| | | | | |
|---|---|---|---|---|
| JP | 2000 42040 A | * | 2/2000 | |
| JP | 2002 186649 A | * | 7/2002 | |
| SE | 649464 A | * | 5/1985 | 297/DIG. 4 |

* cited by examiner

*Primary Examiner*—Ramon O. Ramirez
(74) *Attorney, Agent, or Firm*—MacMillan, Sobanski & Todd, LLC

(57) ABSTRACT

A support comprises a first support member formed for mounting to a wheelchair frame. A second support member is formed to carry a joystick. A pair of bars has first ends and second ends. The first ends are pivotally mounted to the first support member at spaced apart locations. The second ends are pivotally mounted to the second support member at spaced apart locations to form a four-bar pantographic linkage assembly. The four-bar pantographic linkage assembly produces pantographic movement of the second support member with the joystick carried by the second support member between an extended position and a retracted position. A latch mechanism is provided between the pair of bars for releasably securing bars together in either the extended position or the retracted position. The latch mechanism includes a magnet exposed along an inner facing side wall of at least one bar. A steel insert is exposed along an inner facing side wall of the other one of the bars. The magnet cooperates with the steel insert to secure the bars in at least one of the extended or retracted positions.

22 Claims, 6 Drawing Sheets

ADJUSTABLE JOYSTICK SUPPORT AND WHEELCHAIR THEREWITH

BACKGROUND OF THE INVENTION

The present invention relates generally to supports and, more particularly, to supports having plural joints adjustable along vertical pivots. Most particularly, the invention relates to adjustable joystick supports for power wheelchairs.

Electric powered wheelchairs are generally controlled by a joystick, which is operably coupled to electric drive motors. The joystick permits a wheelchair occupant to accelerate, steer, and stop the wheelchair. Other conventional steering means are often inappropriate and difficult for severely physically impaired wheelchair occupants to operate. Joysticks, on the other hand, allow those who are severely impaired to control the movement of a wheelchair simply by moving the joystick with a single hand to a position that corresponds to a desired direction of movement.

The joystick is preferably located where the wheelchair occupant can comfortably rest his or her arm on an armrest and operate the joystick free of discomfort. This generally requires the joystick to be placed just forward of a front portion of the armrest at a height where the joystick may be accessed by the wheelchair occupant.

The joystick is often mounted to the distal end of an elongated rod, which is disposed alongside the wheelchair armrest or a side portion of the wheelchair frame. This rod is typically releasably coupled to a bracket mounted to the armrest or the wheelchair frame. The bracket is typically formed to slideably receive the rod. Hence, the rod and the joystick carried thereby can slide forward, away from the armrest, or rearward, toward the armrest, in a direction along the longitudinal axis of the rod for length adjustment purposes.

While this joystick support has been adequate to adjust the location of the joystick device along the longitudinal axis of the rod, several operational problems are inherent in this design. For example, a locking mechanism to secure the rod relative to the bracket often must be loosened, usually by turning a knob, in order to permit the rod to slide forward or rearward. Subsequently, the locking mechanism must be tightened in order to retain the position of the joystick. Moreover, to move the joystick each time, this sequence of events must be repeated. This tends to be difficult and laborious to those severely impaired.

Another problem that has been encountered in connection with this joystick support is that the support positions the joystick forward of the armrest. Because of the wheelchair occupant's limited mobility, it is often desirable to position the wheelchair as close as possible to a work surface, such as a table, desk, or the like, for greater access and convenience and to provide a practical working environment. Thus, in situations where the work surface is placed at a height similar to that of the joystick, the wheelchair may only be moved as close to the work surface as the joystick permits. Traditional joystick supports may be retracted somewhat in the direction along the longitudinal axis of the rod; however, without removal of the joystick, the joystick is still positioned between the armrest and the work surface.

Finally, ingress and egress to and from the wheelchair is more difficult since the joystick projects forward from the armrest because this impairs passage to and from the wheelchair.

SUMMARY OF THE INVENTION

The present invention is directed toward a support that overcomes the foregoing problems and deficiencies. A support according to the invention is comprised of a first support member formed for mounting to a wheelchair frame. A second support member is formed to carry a joystick. A pair of bars has first ends and second ends. The first ends are pivotally mounted to the first support member at spaced apart locations. The second ends are pivotally mounted to the second support member at spaced apart locations to form a four-bar pantographic linkage assembly. The four-bar pantographic linkage assembly produces pantographic movement of the second support member with the joystick carried by the second support member between an extended position and a retracted position. A latch mechanism is provided between the pair of bars for releasably securing bars together in either the extended position or the retracted position. The latch mechanism includes a magnet exposed along an inner facing side wall of at least one bar. A steel insert is exposed along an inner facing side wall of the other bar. The magnet cooperates with the steel insert to secure the bars in at least one of the extended or retracted positions.

In another embodiment of the invention, an armrest is mounted to a wheelchair frame. A joystick support is slideably mounted to the wheelchair frame adjacent the armrest. The support comprises a first support member including an elongate rod having a distal end and a first pair of mounting plates disposed on the distal end thereof proximate a front portion of the wheelchair frame. The joystick is carried by a second support member. The second support member includes a second pair of mounting plates. A pair of bars has first ends and second ends. The first ends are pivotally mounted to the first pair of mounting plates at spaced apart locations and the second ends are pivotally mounted to the second pair of mounting plates at spaced apart locations to form a four-bar pantographic linkage assembly. The four-bar pantographic linkage assembly produces pantographic movement of the second support member with the joystick carried by the second support member between an extended position and a retracted position. A latch mechanism is supported by the bars to releasably secure the bars in at least one of the retracted or extended positions. The latch mechanism includes a magnet exposed along an inner facing side wall of at least one of the bars and a steel insert exposed along an inner facing side wall of the other bar. The magnet cooperates with the steel insert to secure the bars in at least one of the extended or retracted positions.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
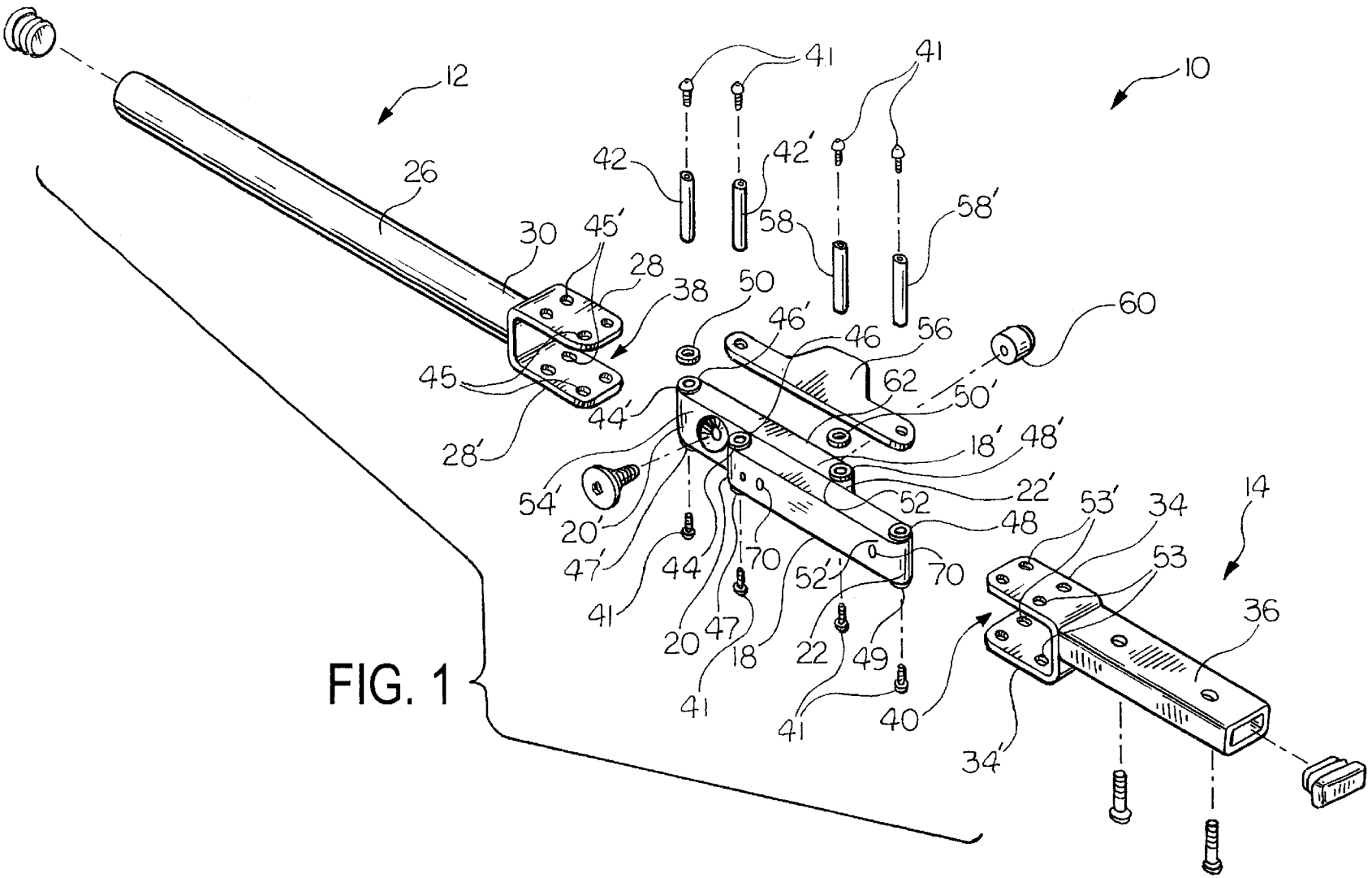
FIG. 1 is an exploded front perspective view of a remote control support according to present invention.

Referring now to the drawings, wherein like components are designated by like reference numerals throughout the various figures, there is illustrated in FIG. 1 a swing-away joystick support, generally designated 10. Briefly, the joystick support 10 of the present invention includes a first support member, generally designated 12, formed for mounting to a wheelchair frame 11 (shown in FIG. 6) and a second support member, generally designated 14, formed to carry a joystick 16 (also shown in FIG. 6). A pair of bars, generally designated 18 and 18', are pivotally mounted at first ends 20 and 20', respectively, to the first support member 12 at spaced apart locations. Similarly, the pair of bars 18 and 18' is pivotally mounted at second ends 22 and 22', respectively, to the second support member 14 at spaced apart locations. This configuration, essentially a four-bar pantographic linkage assembly, as will be described in greater detail below, produces pantographic movement of the second support member 14 with the joystick 16 carried by the second support member 14 between an extended position (shown in FIGS. 3 and 4) and a retracted position (shown in full in FIG. 6). The pantographic motion of the second support member 14 causes the joystick 16 to swing away along an arcuate path to a position of retraction lateral to the wheelchair frame 11 without changing its angular orientation relative to the wheelchair. Therefore, the wheelchair may be positioned closer to a work surface 19 (shown in FIG. 6) or the like. Additionally, ingress and egress to and from the wheelchair may be eased by positioning the joystick 16 away from the entrance to the wheelchair seat (not shown).

Figure 6:
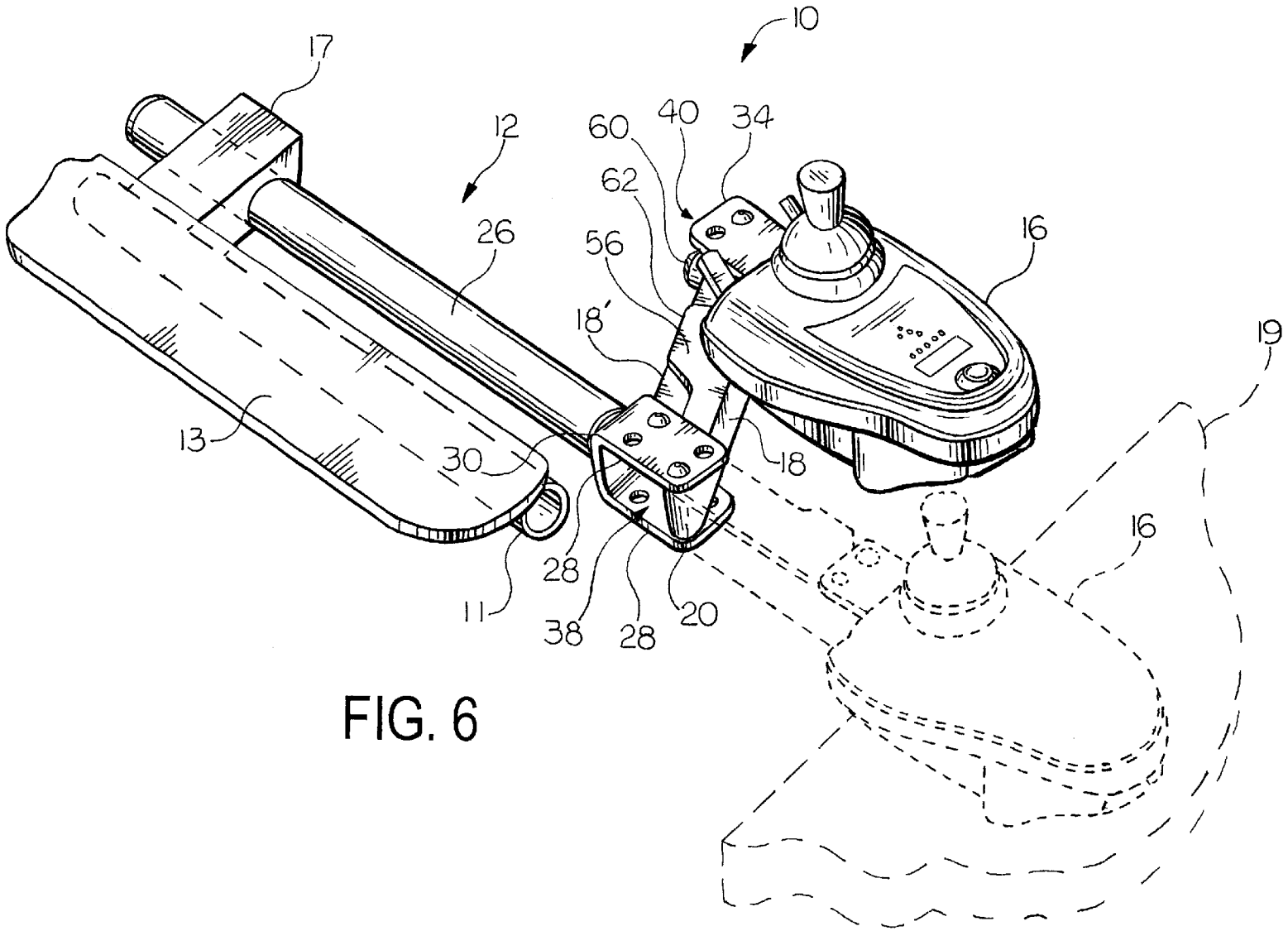
FIG. 6 is a front perspective view of the remote control support supporting a remote control and coupled to a wheelchair frame wherein the support is shown extended in phantom line and retracted in solid line.

A latch mechanism 24 (shown in FIGS. 3 and 4) is provided between the pair of bars 18 and 18' for releasably securing bars 18 and 18' together in either the extended position (shown in FIGS. 3 and 4) or the retracted position (shown in full in FIG. 6). The latch mechanism 24 also enables the joystick 16 to be secured relative to the wheelchair frame 11 during normal operational use, or when in the extended and retracted positions. As will become more apparent in the description that follows, the latch mechanism 24 may be released from the extended and retracted positions by a single-handed operation of the pantographic linkage by the user to move the joystick 16 along the arcuate path. This operation is particularly important because it is often extremely difficult for those severely impaired to operate latch mechanisms. Hence, by providing a latch mechanism that may be operated single handedly, the user can more easily extend or retract the linkage as desired.

Now, the joystick support 10 will be described in greater detail. A wheelchair frame 11 (shown in FIG. 6) is formed to support or carry an armrest 13 (also shown in FIG. 6) mounted atop the frame 11. As above indicated, it is desirable to position the joystick 16 (shown in FIG. 6), during operation, at a height where a wheelchair occupant may operate the joystick 16 comfortably while resting his or her arm on the armrest 13. Typically, the prior art joystick supports are mounted to the frame 11 adjacent the armrest 13. The joystick support 10 of the present invention is adapted to be slideably mounted to a wheelchair frame 11 adjacent the armrest 13 so that the joystick 16 may be placed at a substantially similar operating position. Accordingly, the support 10 of the present invention may be retrofit to most existing wheelchairs employing joysticks.

As shown, the first support member 12 includes an elongated hollow rod 26 having a first pair of mounting plates 28 and 28' disposed on one distal end 30 thereof proximate the front portion of the wheelchair. A frame mounting bracket 17 (shown in FIG. 6) may be affixed to a side portion of the wheelchair frame 11 for slideably mounting the rod 26 adjacent the armrest 13. The mounting bracket 17 may provide a passageway formed to receive the opposite end of the rod 26 to permit relative slideable movement therebetween along a longitudinal axis of the rod 26. Accordingly, the second support member 14 and the joystick 16 carried thereby, which are coupled to the first pair of mounting plates 28 and 28', may be moved along the longitudinal axis of the rod 26 to adjust the position of the joystick 16 relative to the armrest 13.

A securing device (not shown), coupled to the frame mounting bracket 17, is adapted to releasably secure the rod 26 against the frame mounting bracket 17 to prevent slideable movement therebetween. The securing device includes a knob member movable between a secured position and a released position, which enables the rod 26 to be secured or moved relative to the frame mounting bracket 17. It should be understood that the means for mounting the rod 26 to the frame is broadly old and does not constitute a novel aspect of the present invention.

The second support member 14 is preferably a mounting bracket formed to carry the joystick 16 (shown in FIG. 6) therefrom. The second support member 14 includes a second pair of mounting plates 34 and 34', in which second ends 22 and 22' are pivotally mounted thereto, and a joystick mounting end 36 formed to be secured to a bottom wall of the joystick 16 by mounting fasteners (not shown).

In the preferred form, the distal end 30 of the first support bar 12 is provided with a first channel 38, which extends between the first pair of mounting plates 28 and 28'. The channel 38 is formed and dimensioned to receive the first ends 20 and 20' of the bars 18 and 18'. The channel 38 extends by a distance sufficient to permit the bars 18 and 18' to pivot about the first pair of mounting plates 28 and 28' free from obstruction. Likewise, a second channel 40 extends between the second pair of mounting plates 34 and 34'. The second channel 40 is formed and dimensioned to receive the second ends 22 and 22' of the bars 18 and 18'. This channel 40 likewise extends by a distance sufficient to permit the bars 18 and 18' to pivot about the first pair of mounting plates 28 and 28' free from obstruction.

The first ends 20 and 20' of the bars 18 and 18' are pivotally mounted to the first pair of mounting plates 28 and 28' in a manner similar to the pivotal mounting of the second ends 22 and 22' to the second pair of mounting plates 34 and 34'. Thus, for the ease of description, only one mounting end side will be described in great detail.

As best viewed in FIG. 1, the first ends 20 and 20' of the bars 18 and 18' are pivotally mounted to the first pair of mounting plates 28 and 28' by first pivotal pins 42 and 42' extending through vertically aligned apertures 44, 44', 45 and 45' provided in both the first ends 20 and 20' and the first pair of mounting plates 28 and 28'. The bars 18 and 18', and hence the second support member 14, pivot about the pins 42 and 42', which are preferably oriented substantially vertically. Accordingly, the bars 18 and 18' pivot about the first pivotal pins 42 and 42' in a substantially horizontal plane.

First spacers 46, 46', 47 and 47' are provided between the first pair of mounting plates 28 and 28' and the first ends 20 and 20' of the bars 18 and 18'. The spacers 46, 46', 47 and 47' reduce friction and shimmy between the bars 18 and 18' and the first mounting plates 28 and 28' as the bars 18 and 18' pivot about the first pivot pins 42 and 42'. Preferably, the spacers 46, 46', 47 and 47' are composed of a friction reducing or flexible material such as graphite, plastic or the like. Consequently, when the ends 20 and 20' are inserted in their respective channel 38 and the bars 18 and 18' pivot about the pins 42 and 42', respectively, the ends 20 and 20' contact the spacers 46, 46', 47 and 47', which reduce friction and wear therebetween. It should be understood, of course, that the thickness of the spacers 46, 46', 47 and 47' may vary depending on the tolerances and specifications.

As above indicated, the second ends 22 and 22' of the bars 18 and 18' are pivotally mounted to the second support member 14 in a substantially similar fashion that the first ends 20 and 20' are mounted to first support member 12. Briefly, the second ends 22 and 22' of the bars 18 and 18' are inserted into the second channel 40 with spacers 48, 48' and 49, respectively, therebetween. Spaced apart second pivotal pins 58 and 58' extend through apertures 52, 52', 53 and 53' provided in both the second ends 22 and 22' and the second mounting plates 34 and 34' so that the bars 18 and 18' pivot about the second pivotal pins 58 and 58'.

Figure 3:
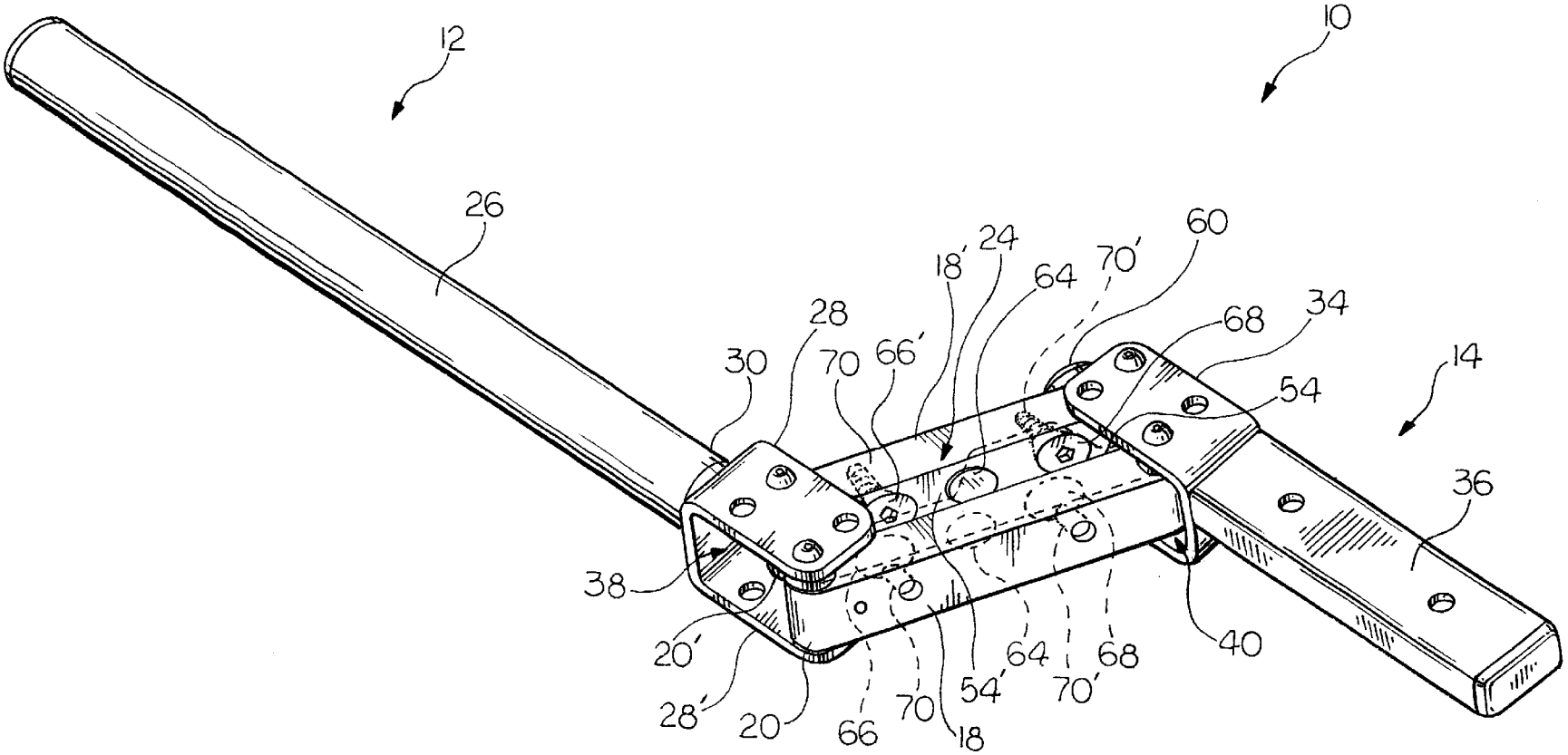
FIG. 3 is an enlarged front perspective view of the remote control support shown in FIG. 1 in an intermediate position.
Figure 4:
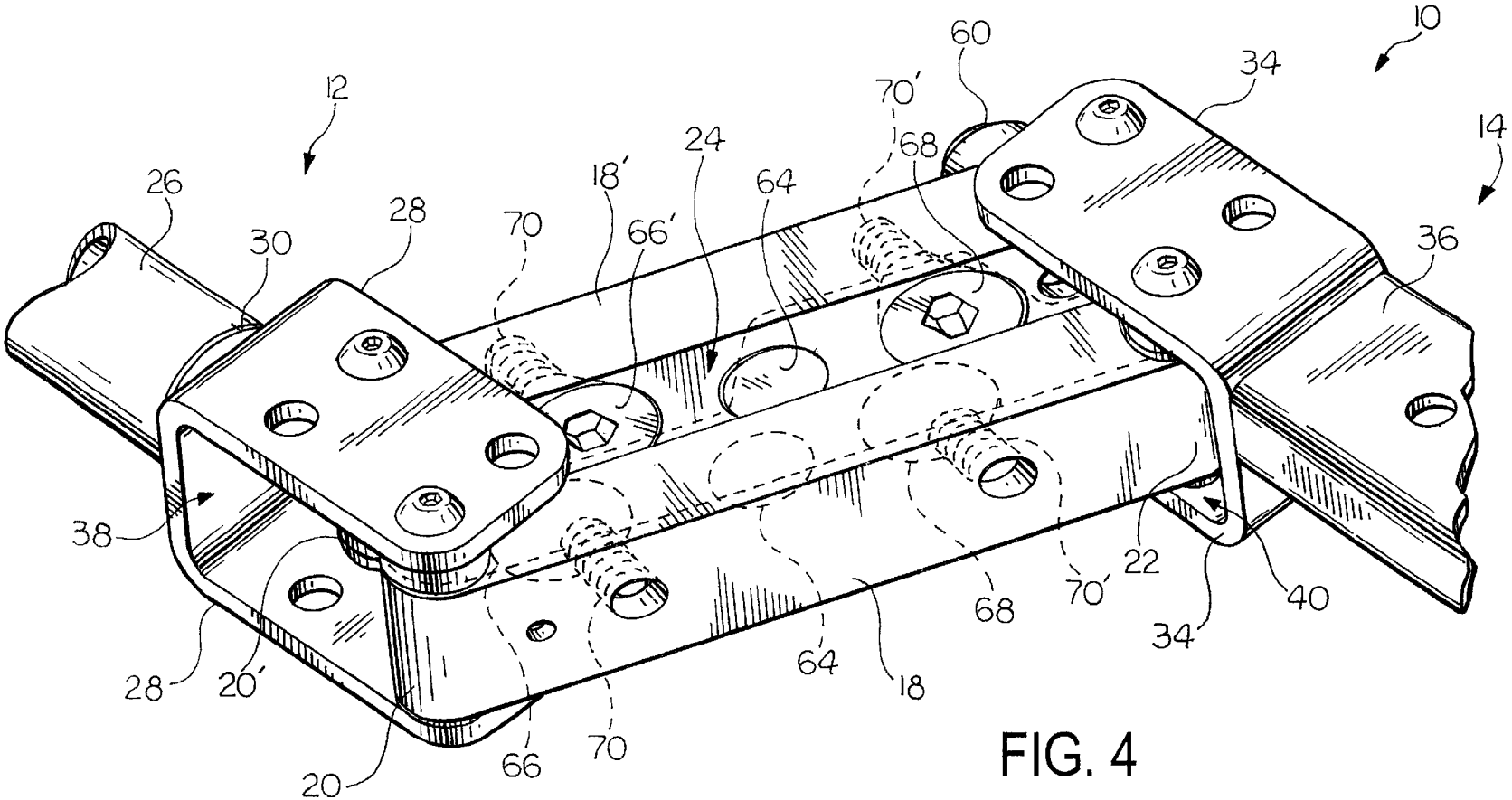
FIG. 4 an enlarged front perspective view of the remote control support shown in FIG. 3.

Preferably, the outer bar 18' and the inner bar 18 are substantially similar in length, as may be seen in the extended position of FIGS. 3 and 4. Further, the first pivotal pins 42 and 42' and the second pivotal pins 58 and 58' are spaced apart diagonally relative the first mounting plates 28 and 28' and the second mounting plates 34 and 34', respectively, in substantially similar diagonal orientations. This configuration pivotally mounts the outer bar 18' and the inner bar 18 substantially parallel to one another between the first support member 12 and the second support member 14 at locations producing pantographic movement of the second support member 14. Moreover, the parallel mounted bars 18 and 18' cooperate to move the joystick 16 (shown in FIG. 6), while maintaining substantially the same orientation, acurately between the extended position (shown in FIGS. 3 and 4) and the retracted position (shown in full in FIG. 6). This allows a wheelchair occupant to move the wheelchair using the joystick 16 by displacing the joystick 16 in the same direction in both the operating and stored positions.

Figure 2:
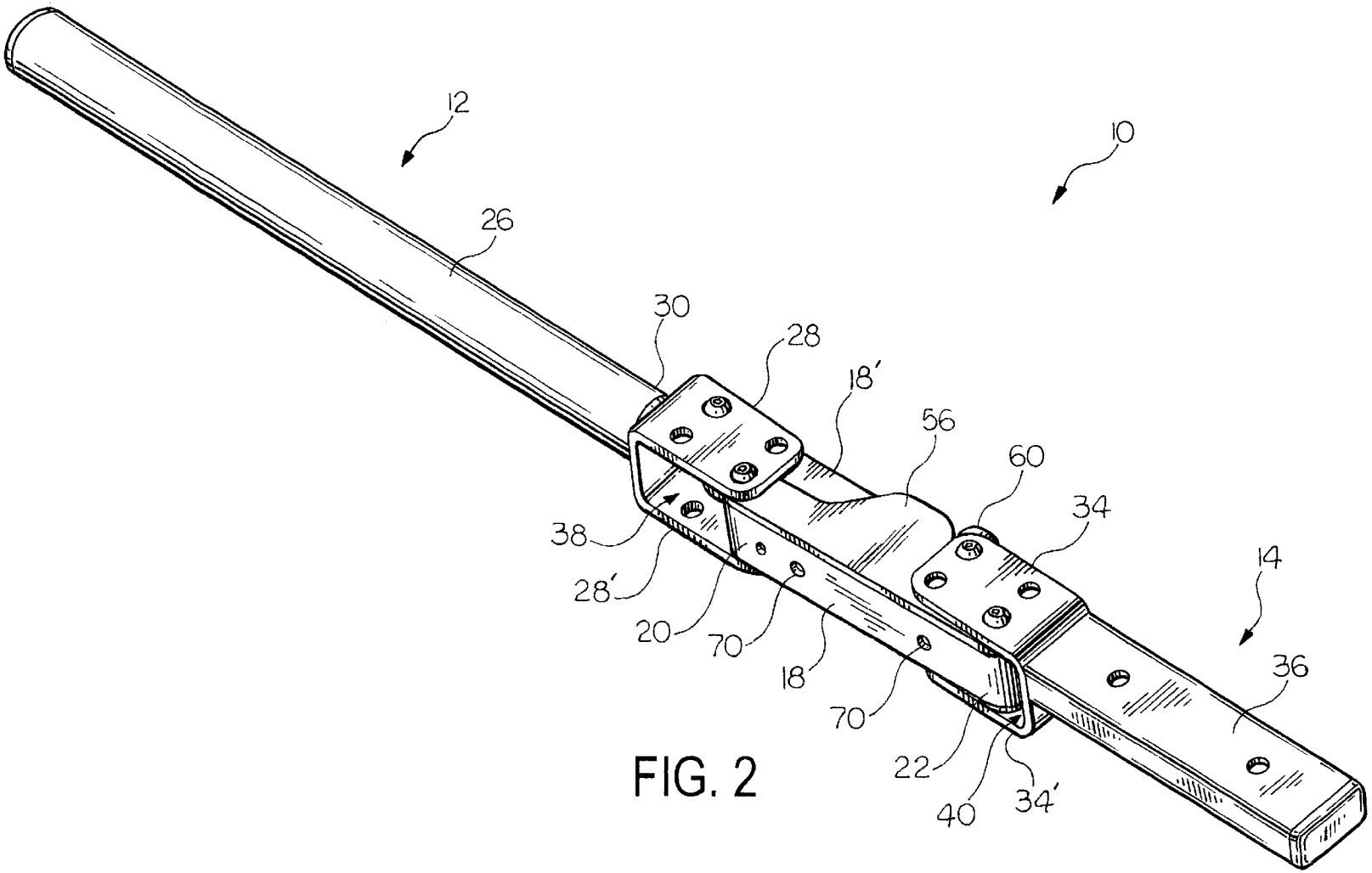
FIG. 2 is an enlarged front perspective view of the remote control support shown in FIG. 1 in an extended position.

Because of the diagonal positioning of the first and second pivotal pins 42, 42', 58 and 58', when the support 10 is positioned in the fully extended position, the inner facing side wall 54' (shown in FIG. 4) of the outer bar 18' engages the inner facing side wall 54 (also shown in FIG. 4) of inner bar 18. As illustrated in FIGS. 1, 2, and 6, this interengagement therebetween prevents further pivotal motion of the bars 18 and 18' in the clockwise direction. In the preferred embodiment, this fully extended position also coincides with aligning the bars 18 and 18' in a direction substantially along the longitudinal axis of the rod 26.

To retract the support 10 to the retracted position (shown in FIGS. 3 and 4), the bars 18 and 18' move pivotally about the first pivotal pins 42 and 42' in a counter clockwise direction until inner facing side walls 54 and 54' again engage one another, as shown in full in FIG. 6. Similar to the extended position, engagement between the inner facing side walls 54 and 54' prevents further retraction in the counter clockwise direction. The degree of retraction is a function of the spacing between the bars 18 and 18' as well as the diagonal orientation between the first pivotal pins 42 and 42', and between the second pivotal pins 58 and 58'. Moreover, it should be understood that, should the joystick support 10 be mounted to the opposite side of the wheelchair seat (not shown), the diagonal orientation of the first and second pivotal pins 42, 42', 58 and 58' relative to the first support member 12 and the second support member 14, respectively, would be reversed so that the bars 18 and 18' could rotate clockwise about the first pivotal pins 42 and 42' from the extended position to the retracted position.

Accordingly, the joystick support 10 of the present invention pantographically retracts the joystick 16 (shown in FIG. 6) to the retracted position to the wheelchair armrest 13 (also shown in FIG. 6). This accords the wheelchair occupant closer access to a work surface 19 (shown in FIG. 6) when seated in the wheelchair. Moreover, the support 10 of the present invention enables accurate repositioning of joystick 16 back to the extended position without the need to readjust the rod 26 relative to the wheelchair frame mounting bracket 17 (shown in FIG. 6), contrary to the prior art assemblies. Finally, ingress and egress to and from the wheelchair may be eased by positioning the joystick 16 away from the wheelchair seat entrance to the retracted position.

Now, the latch mechanism 24 will be described in greater detail. The latch mechanism 24 is supported by the outer bar 18' and the inner bar 18 to releasably secure the bars 18 and 18', and hence, the joystick 16 in either the extended position (shown in FIGS. 3 and 4) or the retracted position (shown in full in FIG. 6). As previously mentioned, in both the extended position and the retracted position, the inner facing side walls 54 and 54' of the bars 18 and 18', respectively, are interengaged to prevent further motion therebetween in the respective direction. Accordingly, the latch mechanism 24 locks the inner and outer bars 18 and 18' together to prevent further movement of the joystick 16 until the latch mechanism 24 is released.

As best shown in FIG. 4, the latch mechanism 24 preferably includes two magnets 64 and 64' exposed along the inner facing side walls 54 and 54' of the bars 18 and 18'. The magnets 64 and 64' may be attached to the surface of the inner facing side walls 54 and 54' or extend laterally within the bars 18 and 18' in a direction parallel to a longitudinal axis of the bars 18 and 18'. The magnets 64 and 64' are adapted to cooperate with steel inserts 66, 66', 68 and 68'. The steel inserts 66, 66', 68 and 68' are likewise exposed along the inner facing side walls 54 and 54'. Similar to the magnets 64 and 64', the steel inserts 66, 66', 68 and 68' extend laterally within the bars 18 and 18'in a direction parallel to a longitudinal axis of the bars 18 and 18'.

Each magnet 64 and 64' cooperates with a steel insert 68' and 66 along an inner facing side walls 54 and 54' of an opposing bar 18 and 18' when the bars 18 and 18' are moved to the extended position and another insert 66' and 68 along an inner facing side walls 54 and 54' of an opposing bar 18 and 18' when the bars 18 and 18' are moved to the retracted position. The magnets 64 and 64' cooperate with the steel inserts 66, 66', 68 and 68' to secure the bars 18 and 18' in the extended and retracted positions.

The inserts 66, 66', 68 and 68' are adjustable relative to the bars 18 and 18'. The inserts 66, 66', 68 and 68' are preferably threaded into threaded apertures 70 and 70' in the bars 18 and 18'. Hence, the inserts 66, 66', 68 and 68' may be threadably adjusted so that the inserts 66, 66', 68 and 68' extend from or are flush with or recessed within the inner facing side walls 54 and 54' of the bars 18 and 18'. This adjustment permits a space to be provided between the magnets 64 and 64' and the inserts 66, 66', 68 and 68'.

A space between the magnets 64 and 64' and the inserts 66, 66', 68 and 68' weakens the attractive force between the magnets 64 and 64' and the inserts 66, 66', 68 and 68'. The greater the distance of space between the magnets 64 and 64' and the inserts 66, 66', 68 and 68', the weaker the attractive force. By weakening the attractive force, the bars 18 and 18' are less securely coupled together and thus easier to move from the extended and retracted positions. Conversely, by strengthening the attractive force, the bars 18 and 18' are more securely coupled together and thus harder to move from the extended and retracted positions.

Once the bars 18 and 18' are uncoupled, to provide greater control of the movement of the bars 18 and 18', it may be desirable to reduce the ease with which the bars 18 and 18' move. As shown in the drawings, the joystick support 10 is assembled with fasteners 41 that are adapted to be threaded into upper and lower ends of the pivot pins 42, 42'. One or more of these fasteners 41 can be tightened to adjust the amount of force it applies against the bars 18 and 18'. By increasing the amount of force applied, the bars 18 and 18' become more difficult to move. Hence, the fasteners 41 can be adjusted so that a user with minimal dexterity can easily control the movement of the bars 18 and 18' without overcompensation.

Figure 5:
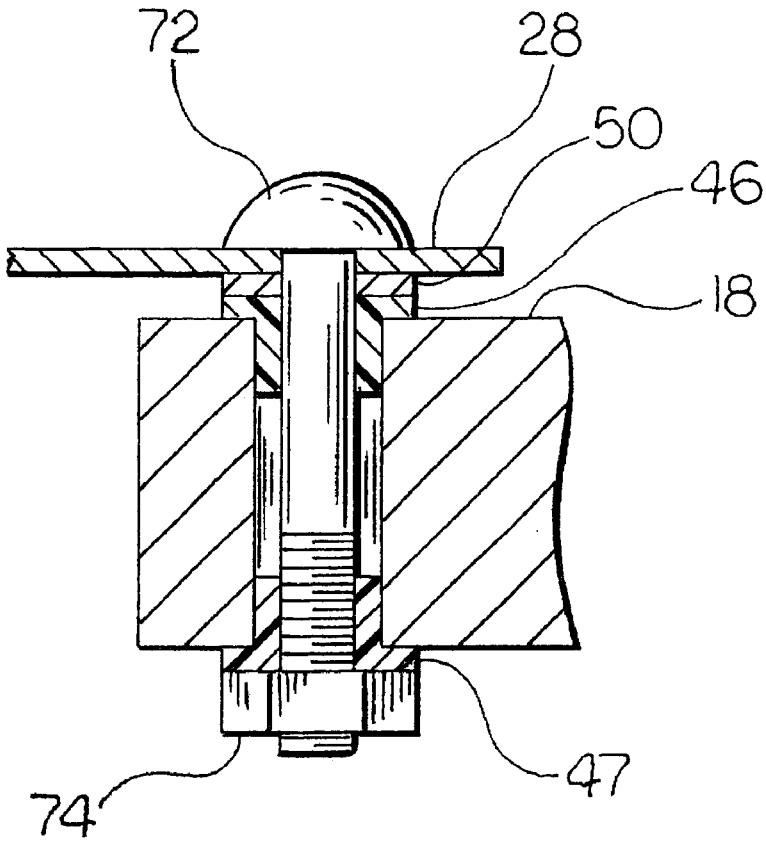
FIG. 5 is a enlarged sectional view of an alternative pivot arrangement.

It should be appreciated that the pins 42, 42', 58 and 58' and fasteners 41 shown are provided for illustrative purposes and that other pivot arrangements may be used in combination with, or in substitution of, the pins 42, 42', 58 and 58' and fasteners 41 shown. For example, a fastener, such as the cap screw 72 shown in FIG. 5, may be substituted in the place of one or more of the pivot pins 42, 42', 58 and 58'. A lock nut 74 may be secured to the bottom of the cap screw 72 to hold the cap screw 72 in place. By tightening the nut 74, an increased amount of force may be applied against the bars 18 and 18'. Like the force of the configuration described above, this force makes the bar 18 and 18' more difficult to move and hence, easier to control.

It is desirable to maintain a safe environment for the wheelchair occupant. With this in mind, an anti-pinch plate 56 is provided for covering the area between the bars 18 and 18'. This plate 56 reduces the risk that the wheelchair occupant will be pinched between the bars 18 and 18' when moving the bars 18 and 18'. This plate 56 is sandwiched between upper spacers 46 and 48 of the inner bar 18 and the upper mounting plates 28 and 34. The introduction of the anti-pinch plate 56 will produce a gap between the upper spacers 46' and 48' of the outer bar 18' and the upper mounting plates 28 and 34 if the plates 28, 28', 34 and 34' are substantially parallel and the bars 18 and 18' and spacers 46, 46', 47 and 47' and 48, 48' and 49 are substantially of the same dimensions. Consequently, an additional spacers 50 and 50' may be required between the upper spacers 46' and 48' of the outer bar 18' and the upper mounting plates 28 and 34. These spacers 50 and 50' fill the gap between the upper spacers 46' and 48' of the outer bar 18' and the upper mounting plates 28 and 34 resulting from the use of the anti-pinch plate 56.

As another protective measure, a bumper 60 may be provided for protecting the wheelchair occupant from injury from the outer bar 18' and the second pair of mounting plates 34 and 34' when pushing on the bar 18' to move the bars 18 and 18' from the retracted position to the extended position. This bumper 60 is attached to the outer facing side wall 62 of the outer bar 18' proximate the second end 22' of the outer bar 18' and the second pair of mounting plates 34 and 34'.

While the present invention was described with reference to a specific embodiment, the description is illustrative of the invention and is not to be construed as limiting the invention. Various modifications to the present invention can be made to the preferred embodiments by those skilled in the art without departing from the true spirit and scope of the invention as defined by the appended claims.

What is claimed is:

1. A swing-away joystick support for mounting a joystick to a wheelchair frame, the support comprising:

a first support member formed for mounting to a wheelchair frame;

a second support member formed to carry a joystick;

a pair of bars having first ends and second ends, the first ends pivotally mounted to the first support member at spaced apart locations and the second ends pivotally mounted to the second support member at spaced apart locations to form a four-bar pantographic linkage assembly, which produces pantographic movement of the second support member with the joystick carried by the second support member between an extended position and a retracted position; and a latch mechanism provided between the pair of bars for releasably securing bars together in either the extended position or the retracted position, the latch mechanism including a magnet exposed along an inner facing side wall of at least one bar and a steel insert exposed along an inner facing side wall of the other one of the bars, the magnet cooperating with the steel insert to secure the bars in at least one of the extended or retracted positions.

2. The support according to claim 1, wherein the steel insert extends laterally within the other one of the bars in a direction parallel to a longitudinal axis of the other one of the bars.

3. The support according to claim 1, wherein the latch mechanism further including another magnet along an inner facing side wall of the other one of the bars and another steel insert exposed along an inner facing side wall of at least one bar, each of the magnets cooperating with one of the steel inserts to secure the bars in at least one of the extended or retracted positions.

4. The support according to claim 1, wherein the latch mechanism further includes another steel insert along the inner facing side walls of each of the bars, each one of the magnets cooperating with one of the steel inserts along the inner facing side wall of an opposing one of the bars when the bars are moved to the extended position and another one of the inserts along the inner facing side wall of the opposing one of the bars when the bars are moved to the retracted position.

5. The support according to claim 1, wherein the insert is adjustable relative to the bars.

6. The support according to claim 1, wherein the insert is threaded into a threaded aperture in the bar, the insert being threadably adjusted so that a space to be provided between the magnet and the insert.

7. The support according to claim 1, wherein the ends of the bars are pivotally mounted with fasteners, the fasteners being adapted to applied an amount of force against the bars, the force making the bar more difficult to move and easier to control.

8. In combination:

a wheelchair frame having a front portion;

an armrest mount on the frame;

a joystick support slideably mounted to the wheelchair frame adjacent the armrest, the support comprising:

a first support member including an elongate rod having a distal end and a first pair of mounting plates disposed on the distal end thereof proximate the front portion of the wheelchair frame;

a second support member carrying the joystick, the second support member including a second pair of mounting plates;

a pair of bars having first ends and second ends, the first ends pivotally mounted to the first pair of mounting plates at spaced apart locations and the second ends pivotally mounted to the second pair of mounting plates at spaced apart locations to form a four-bar pantographic linkage assembly, which produces pantographic movement of the second support member with the joystick carried by the second support member between an extended position and a retracted position; and a latch mechanism supported by the bars to releasably secure the bars in at least one of the extended position or the retracted position, the latch mechanism including a magnet exposed along an inner facing side wall of at least one of the bars and a steel insert exposed along an inner facing side wall of the other one of the bars, the magnet cooperating with the steel insert to secure the bars in at least one of the extended or retracted positions.

9. The combination according to claim 8, further comprising a frame mounting bracket affixed to a side portion of the wheelchair frame for slideably mounting the rod adjacent the armrest.

10. The combination according to claim 9, wherein the mounting bracket is provided with a passageway formed to receive an opposite end of the rod to permit relative slideable movement between the passageway and the rod along a longitudinal axis of the rod.

11. The combination according to claim 8, wherein the second support member is a mounting bracket formed to carry the joystick.

12. The combination according to claim 8, wherein a first channel extends between the first pair of mounting plates and a second channel extends between the second pair of mounting plates, the first channel being formed and dimensioned to receive the first ends of the bars, the second channel being formed and dimensioned to receive the second ends of the bars.

13. The combination according to claim 8, further comprising first spacers provided between the first pair of mounting plates and the first ends of the bars and second spacers provided between the second pair of mounting plates and the second ends of the bars, the spacers reducing friction and shimmy between the bars and the mounting plates.

14. The combination according to claim 8, further including an anti-pinch plate that is provided for covering an area between the bars.

15. The combination according to claim 8, further including a bumper provided attached to an outer facing side wall of an outer one of the bars for protecting the wheelchair occupant from injury from the outer bar and the second pair of mounting plates.

16. The combination according to claim 8, wherein the bars are substantial the same length.

17. The combination according to claim 8, wherein the steel insert extends laterally within the other one of the bars in a direction parallel to a longitudinal axis of the other one of the bars.

18. The combination according to claim 8, wherein the latch mechanism further including another magnet along an inner facing side wall of the other one of the bars and another steel insert exposed along an inner facing side wall of the at least one bar, each of the magnets cooperating with one of the steel inserts to secure the bars in at least one of the extended or retracted positions.

19. The combination according to claim 18, wherein the latch mechanism further includes another steel insert along the inner facing side walls of each of the bars, each one of the magnets cooperating with one of the steel inserts along the inner facing side wall of an opposing one of the bars when the bars are moved to the extended position and another one of the inserts along the inner facing side wall of the opposing one of the bars when the bars are moved to the retracted position.

20. The combination according to claim 8, wherein the insert is adjustable relative to the bars.

21. The combination according to claim 8, wherein the insert is threaded into a threaded aperture in the bar, the insert being threadably adjusted so that a space is to be provided between the magnet and the insert.

22. The combination according to claim 8, wherein the ends of the bars are pivotally mounted with fasteners, the fasteners being adapted to applied an amount of force against the bars, the force making the bar more difficult to move and easier to control.

* * * * *

UNITED STATES PATENT AND TRADEMARK OFFICE

CERTIFICATE OF CORRECTION

PATENT NO. : 6,688,571 B1
DATED : February 10, 2004
INVENTOR(S) : Darryl R. Pauls It is certified that error appears in the above-identified patent and that said Letters Patent is hereby corrected as shown below:

Column 8,
Line 44, replace the words “to be” with the word -- is --
Line 48, delete the word “applied” and insert the word -- apply --
Line 54, replace the word “mount” with the words -- mounted to --

Column 10,
Line 2, delete the word “provided”
Line 7, replace the word “substantial” with the word -- substantially --
Line 39, replace the word “applied” with the words -- apply an --
Line 40, replace the word “bar” with the word -- bars --

Signed and Sealed this

Eighteenth Day of May, 2004

JON W. DUDAS
*Acting Director of the United States Patent and Trademark Office*